US007931341B2

(12) United States Patent
Baird, Jr. et al.

(10) Patent No.: US 7,931,341 B2
(45) Date of Patent: Apr. 26, 2011

(54) NARROW BENCH MINING SYSTEM

(75) Inventors: John A. Baird, Jr., Flatwoods, KY (US); Ian T. Carr, Ashland, KY (US)

(73) Assignee: ICG Addcar Systems, LLC, Ashland, KY (US)

( * ) Notice: Subject to any disclaimer, the term of this patent is extended or adjusted under 35 U.S.C. 154(b) by 743 days.

(21) Appl. No.: 11/489,876

(22) Filed: Jul. 20, 2006

(65) Prior Publication Data

US 2007/0035171 A1 Feb. 15, 2007

Related U.S. Application Data

(60) Provisional application No. 60/704,285, filed on Aug. 1, 2005.

(51) Int. Cl.
*E21C 41/18* (2006.01)

(52) U.S. Cl. ..... 299/64; 299/30

(58) Field of Classification Search ..... 299/64, 299/30

See application file for complete search history.

(56) References Cited

U.S. PATENT DOCUMENTS 3,135,502 A * 6/1964 Muehlman ..... 299/56
3,455,598 A 7/1969 Tweedy et al.
3,621,661 A 11/1971 Allen
3,656,803 A 4/1972 Brown et al.
4,307,982 A * 12/1981 Nelson ..... 405/297
4,796,391 A * 1/1989 Lu ..... 52/73
5,112,111 A 5/1992 Addington et al.
5,232,269 A 8/1993 Addington et al.
5,261,729 A 11/1993 Addington et al.
5,364,171 A * 11/1994 Addington et al. ..... 299/18
5,720,527 A 2/1998 Sartaine et al.
2005/0067879 A1 * 3/2005 Burgess et al. ..... 299/95

OTHER PUBLICATIONS

Georgius Acricola "De Re Metallica" published 1556, p. 372 translated by Hoover, et al.*

* cited by examiner

*Primary Examiner* — John Kreck
(74) *Attorney, Agent, or Firm* — James C. Eaves, Jr.; Greenebaum Doll & McDonald PLLC; Brian W. Chellgren

(57) ABSTRACT

A launch vehicle (10) is provided for a continuous mining system including modular conveyor units (U) that are connected together to form a conveyor train. The launch vehicle (10) includes a main frame (12) for supporting a rearmost conveyor unit (U) of the conveyor train. The main frame (12) includes a first side over which additional conveyor units (U) are added to the conveyor train and a second side. A belly conveyor (14) is carried on the main frame (12). A drive assembly (42) is provided for selectively advancing and withdrawing the conveyor train. Further the launch vehicle (10) includes a canopy (18) overlying the main frame (12). The canopy (18) is mounted on at least one cantilever support (20) extending upwardly adjacent the second side of the main frame (12) whereby the first side is left open for adding additional conveyor units (U) to the conveyor train.

19 Claims, 7 Drawing Sheets

NARROW BENCH MINING SYSTEM

RELATED APPLICATION

This application claims the benefit of and incorporates by reference our U.S. Provisional Patent Application No. 60/704,285, titled Narrow Bench Mining System, filed Aug. 1, 2005.

TECHNICAL FIELD

The present invention relates generally to the art of mining and, more particularly, to a launch vehicle for an apparatus adapted for the continuous mining of aggregate material, such as coal, in situ.

BACKGROUND OF THE INVENTION

Coal, formed from decomposed and compressed vegetable matter, is typically found in substantially horizontal seams extending between sedimentary rock strata such as limestone, sandstone or shale. Surface and underground mining are the primary techniques used to recover this coal.

Surface or strip mining involves the removal of material, known as overburden, overlying a coal seam so as to expose the coal for recovery. In recent years, surface mining has gained prominence over underground mining in the United States. This is due to many factors including:

(a) the increased material moving capacity of surface or strip mining equipment;

(b) lower costs for surface mining than underground mining;

(c) the better safety record of surface mining versus underground mining; and (d) the higher coal recovery percentage for extraction of many coal reserves by surface mining.

Surface mining does, however, have its limitations despite these cited advantages. The primary limiting factor relates to the depth of the overburden. Once the coal seam reaches a certain depth below the surface, the amount of overburden that must be removed to reach the coal simply makes strip mining economically unfeasible.

When this occurs, large quantities of coal may still remain in the ground. If economic recovery of this coal is to be achieved, other mining methods must be utilized. Underground mining application in such an instance is, typically, very limited. This may be due to a number of factors including the existence of poor roof support conditions, the thinness of the seam and/or the presence of insufficient quantities of coal to warrant the large capital investments characteristic of underground operations.

Due to these considerations, auger mining is often used to recover coal following a strip mining operation where the overburden becomes too costly to remove. A large auger is used to bore into the face of the seam and recover the coal from beneath the overburden. Advantageously, auger mining is very efficient providing more tons per man per day than any other form of state of the art mining techniques: Auger mining may also be initiated quickly and requires a relatively low capital expenditure when compared to surface and underground mining. Auger mining has also been found to date to be the best method to use in relatively thin seams. Further, auger mining is safer than both surface and underground mining. Thus, auger mining may be used to effectively supplement a strip mining operation and recover small coal deposits that would otherwise be left behind.

Auger mining is, however, also not without its disadvantages. Auger mining provides a relatively low total coal recovery. Coal recovery for the resource area being augered is usually less than about 35%. Some of the lost recovery is due to the pillars of coal that are left standing to support the overburden between adjacent auger holes. The majority of the recovery shortfall, however, is due to the limited penetration depth achievable with even state of the art auger mining equipment.

More particularly, as penetration depths increase, a greater number of auger flights are required to convey the coal from the cutting head to the seam face for recovery. Each flight adds to the frictional resistance to the turning of the auger through contact with the walls of the bore hole. Additionally, the longer the string of auger flights, the greater the weight of coal being moved by the flights at any one time. As a result, it should be appreciated that auger power requirements increase rapidly with the depth of auger penetration.

Due to the above considerations, holes drilled by conventional augering equipment are usually only of a depth of 150 feet with 200 feet being rarely attainable. Of course, any increase in this figure is desirable as it would greatly improve the coal recovery rate from a resource area.

A mining system and method that was developed to meet this end is disclosed in U.S. Pat. Nos. 5,364,171, 5,261,729 and 5,112,111. These patents are all owned by the assignee of the present invention and the full disclosure of these documents is incorporated herein by reference. As shown and described in these patents and in FIG. 1, the mining system includes a continuous miner M for cutting coal C from a coal seam S. The cut coal C is fed by the miner M to a conveyor train T comprised of a series of modular conveyor units U serially connected end-to-end. This system allows mining to depths far exceeding the 150 to 200 feet possible with conventional auger mining equipment. In fact, depths of over 1500 feet have been reached.

Each conveyor unit U is supported on ground engaging wheels W so as to be adapted to follow the miner M as the miner advances into the coal seam S. A launch vehicle L is also incorporated into this system. The launch vehicle L includes a conveyor mechanism for receiving and conveying aggregate coal discharged by the conveyor train. The launch vehicle L also includes a guide track for supporting the end unit of the conveyor train T and a conveyor unit U to be added to the train. Further, individual drive assemblies are provided for (1) advancing/withdrawing the conveyor train with the miner and for (2) pushing the new conveyor unit into engagement with the conveyor train. Advantageously, the system allows the aggregate coal C to be cut and conveyed without interruption even when a conveyor unit U is being added to the train T. Hence, the system not only provides significantly improved recovery from the resource area but also operates more efficiently than augering equipment and provides improved productivity.

While the mining system and method disclosed in these patents has met with commercial success, the length of the launch vehicle (about 90 feet) has limited its application. Specifically, many existing benches adjacent an exposed highwall are not wide enough to accommodate a launch vehicle of this length. The present invention relates to a redesigned launch vehicle of reduced length (about 45 feet) that still accommodates the modular conveyor units of the mining system. Advantageously, such a launch vehicle allows the mining system to be utilized on relatively narrow benches for the first time.

SUMMARY OF THE INVENTION

To achieve the foregoing and other objects, and in accordance with the purposes of the present invention as described herein, a new launch vehicle is provided for a continuous mining system including modular conveyor units that are connected together to form a conveyor train. The launch vehicle includes a main frame for supporting a rearmost conveyor unit of the conveyor train. The main frame includes a first side over which additional conveyor units are added to the conveyor train and a second, opposite side. A belly conveyor is carried on the main frame beneath the conveyor units. The belly conveyor conveys aggregate material received from the rearmost conveyor unit of the conveyor train. In addition a drive assembly is mounted to the launch vehicle. The drive assembly is utilized to selectively advance or withdraw the conveyor train through the seam being mined. In addition the launch vehicle includes a canopy overlying at least part of the main frame. The canopy is mounted on at least one cantilever support. That cantilever support extends upwardly adjacent the second side of the main frame. In this way the first side is left open for adding additional conveyor units to the conveyor train.

More specifically describing the invention, the belly conveyor is a belt conveyor. The cantilever support may be of box beam construction. Further, the cantilever support may be provided adjacent a first end of the main frame. In one possible embodiment, the canopy is supported on two vertical support posts adjacent a second end of the main frame. A first of those vertical posts is on the first side of the main frame while, the second of the vertical posts is on the second side of the main frame. The launch vehicle also includes a discharge conveyor carried on the main frame adjacent the first end. The discharge conveyor receives aggregate material from the belly conveyor.

The launch vehicle may include a plurality of jacks supporting the main frame on the bench adjacent the exposed highwall. The jacks may be extended or retracted to adjust the inclination of the deck of the launch vehicle to match the bench so that the conveyor units roll freely from the deck of the launch vehicle onto the bench and into the mineral seam.

In accordance with an additional aspect of the present invention, a method is provided for reducing the length of a launch vehicle while maintaining sufficient clearance to allow a conveyor unit to be placed on the launch vehicle from a side thereof. The method comprises the step of supporting a canopy over a main frame of the launch vehicle by means of a cantilever support.

In the following description there is shown and described a preferred embodiment of this invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing, incorporated in and forming a part of this specification, illustrates several aspects of the present invention and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
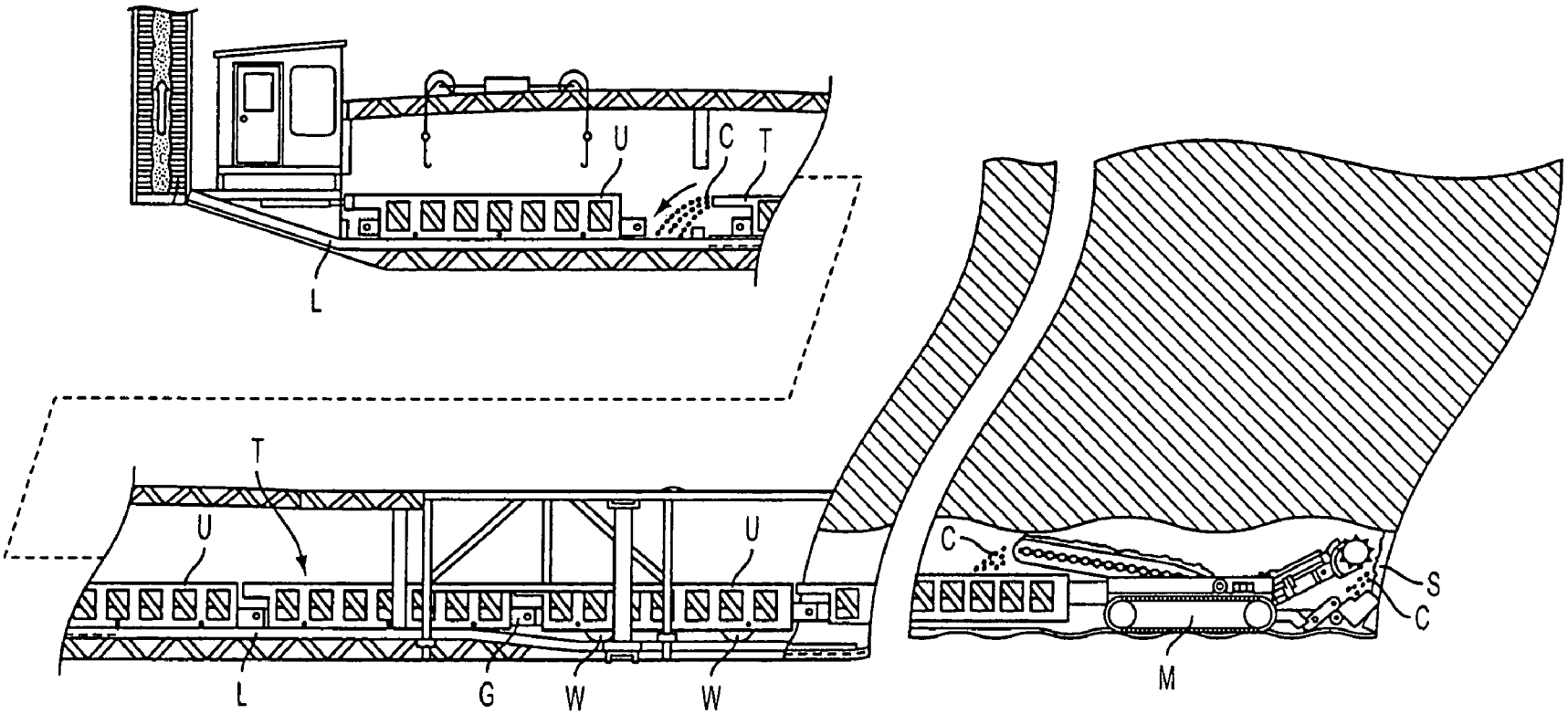
FIG. 1 PRIOR ART
FIG. 1 is a schematical view generally showing the mining system of the prior art.
Figure 2:
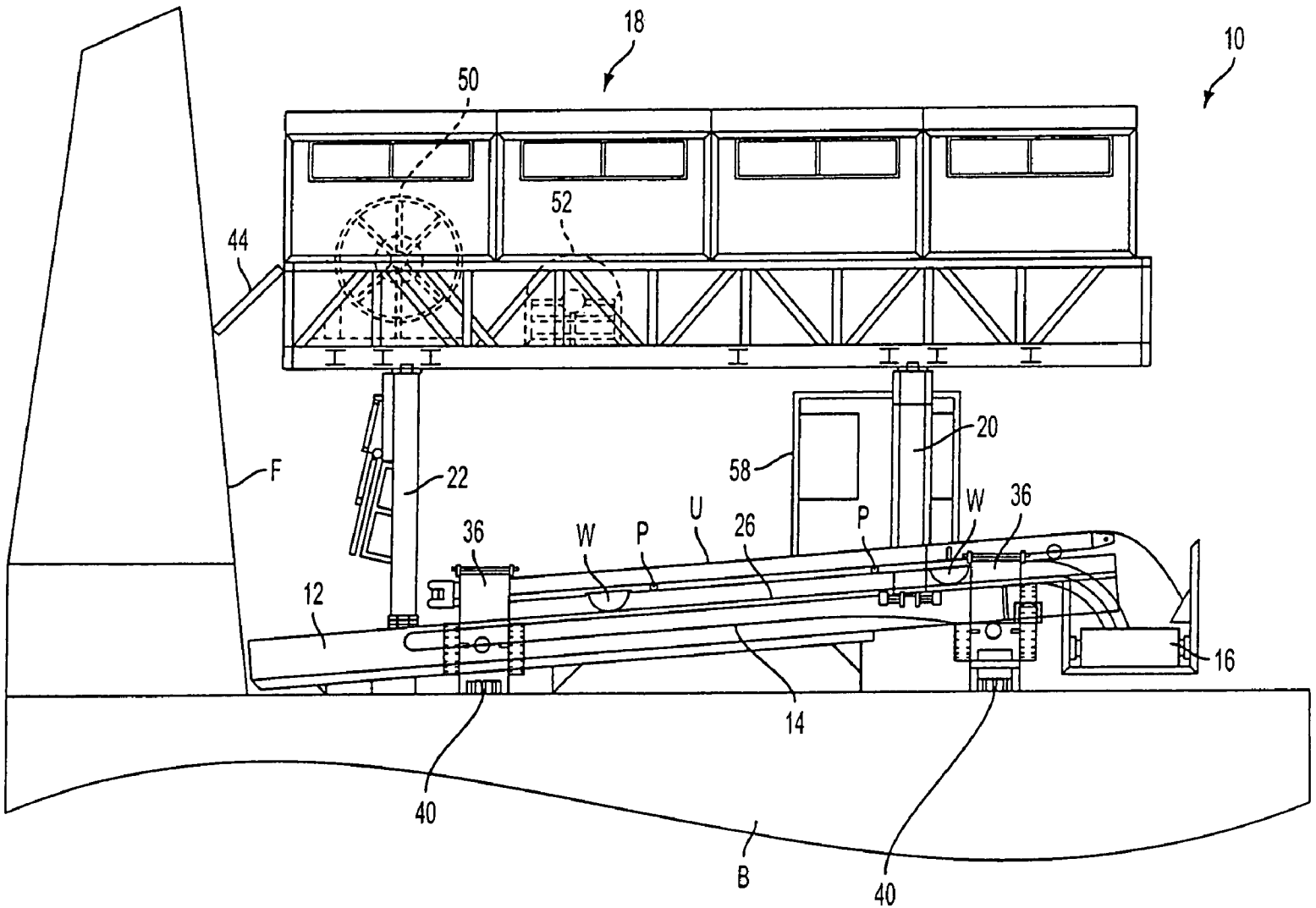
FIG. 2 is a side elevational view of the launch vehicle of the present invention.
Figure 3:
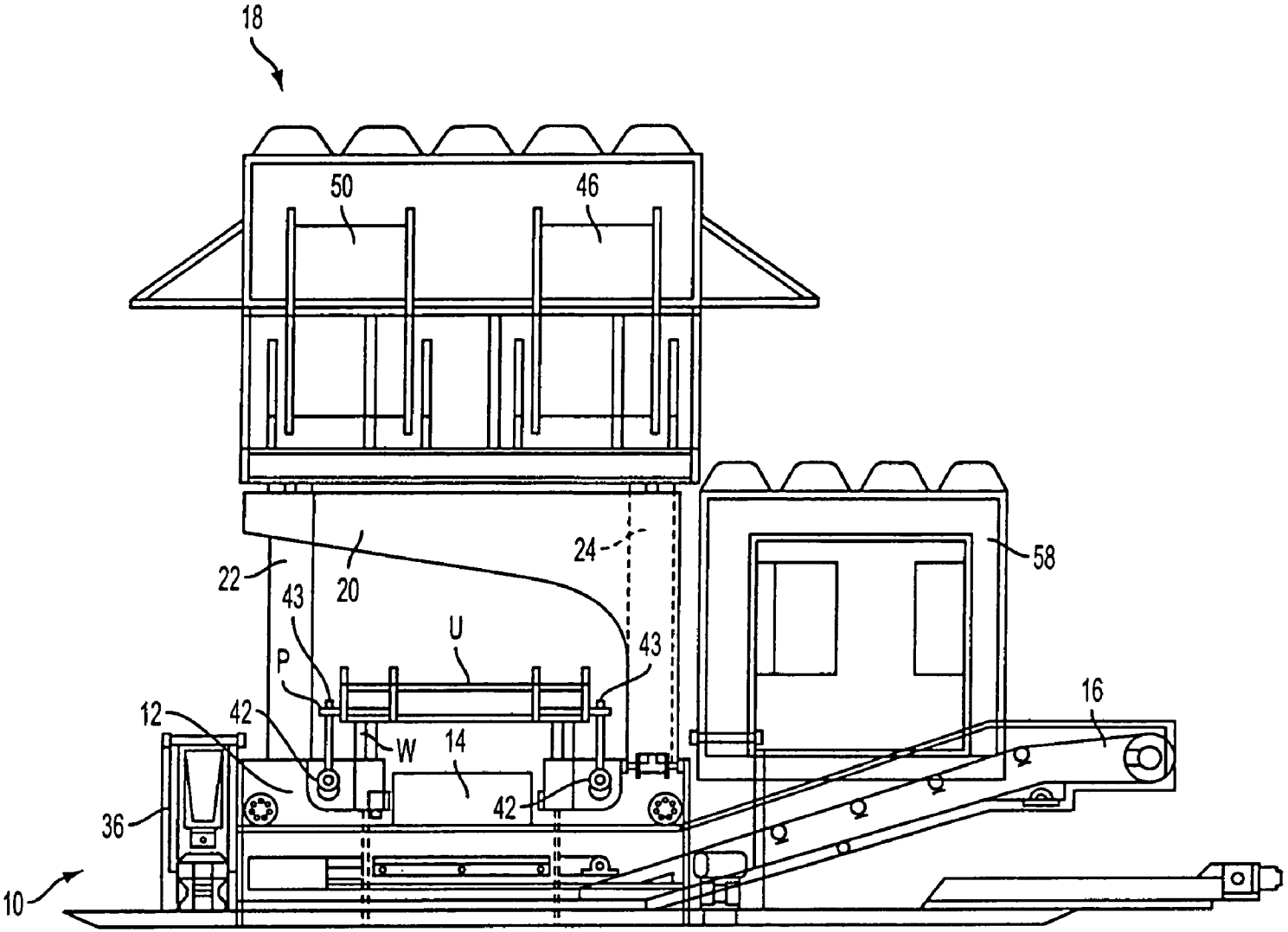
FIG. 3 is a rear end elevational view of the launch vehicle illustrated in FIG. 2.
Figure 4:
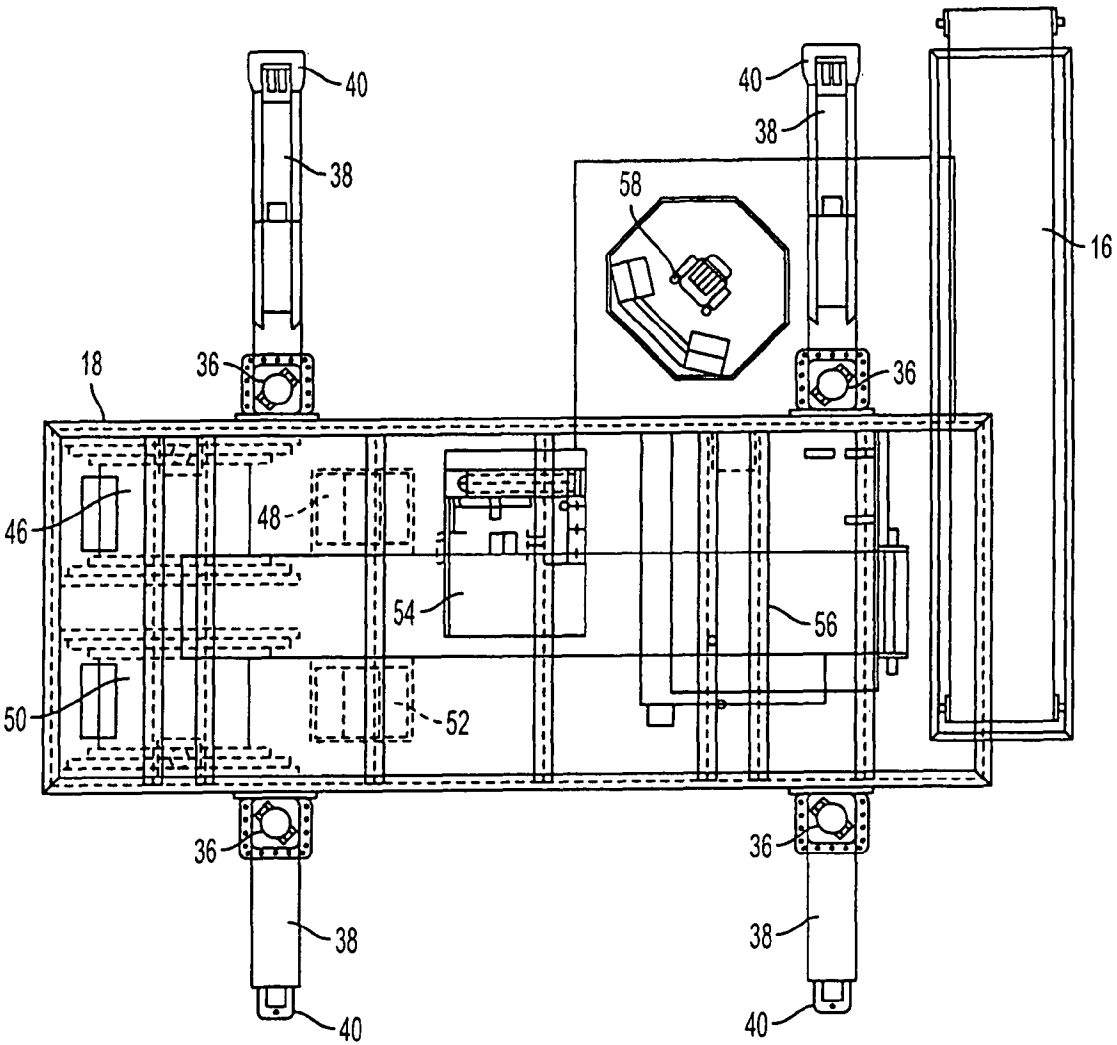
FIG. 4 is a top plan view of that launch vehicle.

Reference is now made to FIGS. 2-4 illustrating the launch vehicle 10 of the present invention for utilization in a highwall mining system of the type described in detail in, for example, U.S. Pat. Nos. 5,364,171, 5,261,729 and 5,112,111 all owned by the assignee of the present invention. The launch vehicle 10 includes a main frame or structural framework 12 that supports an aggregate material "belly" conveyor 14, preferably of the belt type. The conveyor 14 receives the aggregate coal from the last conveyor unit of the conveyor train that is advanced into the seam being mined. The coal is then delivered by the belly conveyor 14 up an incline to a discharge conveyor 16 provided at the rear end of the launch vehicle 10. The discharge conveyor 16 is also inclined and may, for example, be utilized to convey the aggregate coal to a delivery location such as a subsequent inline conveyor utilized to deliver the coal to the bed of a truck which is used to haul the coal away for stockpiling or further processing.

As also illustrated in the drawing figures, the launch vehicle 10 includes a safety canopy 18. In the illustrated embodiment the safety canopy 18 is connected to the main structural framework 12 by a cantilever support 20 at the first or rear end of the launch vehicle 10 and two vertical support posts 22, 24 at a second or front end of the launch vehicle. As illustrated the first support post 22 extends upwardly from a first side of the launch vehicle 10 while the second support post 24 and the cantilever support 20 extend upwardly from a second side of the launch vehicle. Advantageously, the cantilever support 20 functions to support the canopy 18 and eliminates the need to provide a support post on the first side of the launch vehicle at the second or rear end thereof. Accordingly, the first side is left open to allow the necessary clearance for the positioning of an additional conveyor unit onto the deck 26 of the launch vehicle and the extending of the conveyor train that is advanced into the seam being mined while minimizing the overall length of the launch vehicle 10.

Figure 6:
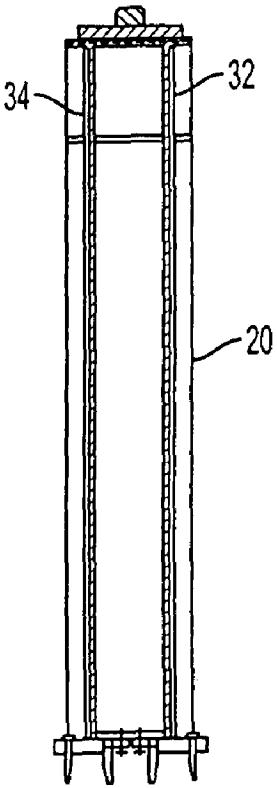
FIG. 6 is a detailed side elevational view of the cantilever support illustrated in FIG. 5.
Figure 5:
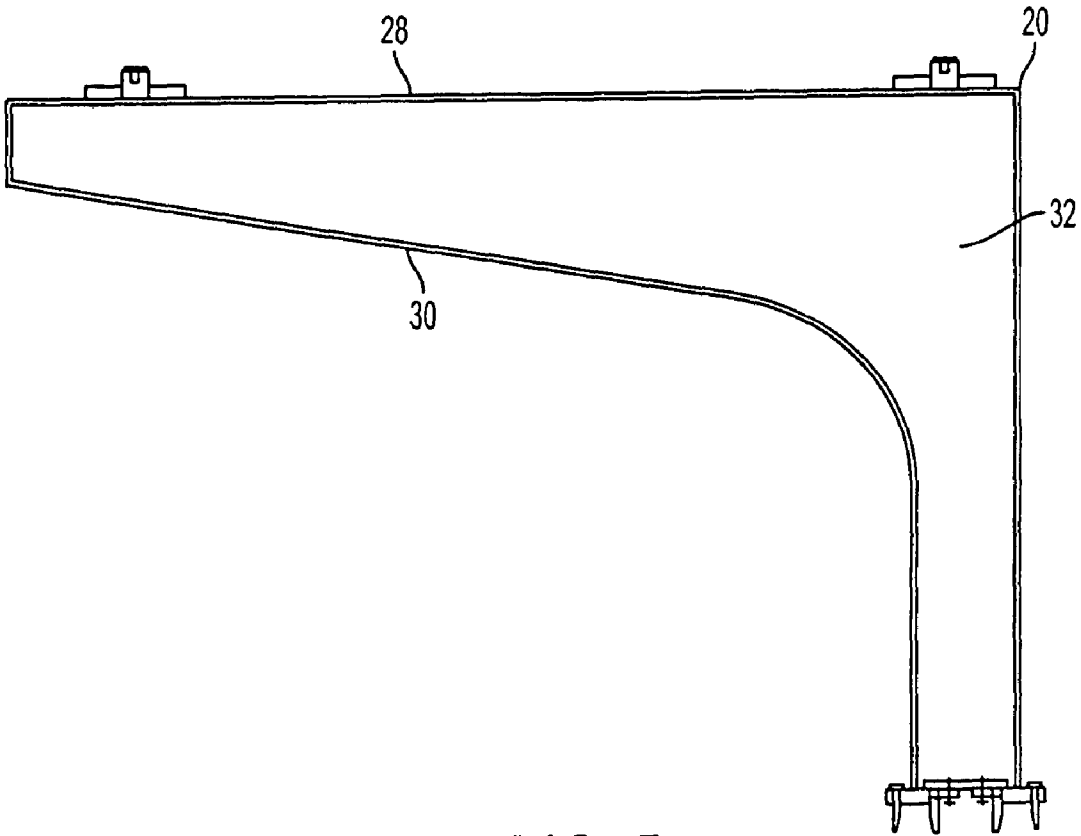
FIG. 5 is a detailed end elevational view of the cantilever support for the canopy of the launch vehicle.

As best illustrated in FIGS. 5 and 6, the cantilever support 20 may be fabricated from two formed high strength steel plates 28, 30 on the top and bottom. These two plates are connected with two high strength steel, vertical webs 32, 34 to fabricate a double I-beam type box section. The plates utilized to fabricate the box section of the cantilever support 20 may, for example, be made from ¾" thick material.

As illustrated, the framework 12 is supported on a series of four jacks 36 positioned adjacent the four corners of the launch vehicle 10. The jacks 36 may be actuated to lift the framework 12 of the launch vehicle from the bench and incline the framework 12 and deck 26 so as to allow each conveyor unit U to be smoothly advanced from the launch vehicle onto the bench and floor of the seam.

An outrigger assembly 38 extends outwardly to the side from each jack housing. The outriggers 38 are utilized to secure the launch vehicle 10 in position on the bench B. More specifically, the feet 40 of the outriggers 38 are placed in engagement with the bench B. These feet 40 may then be pinned to the bench if desired by steel stakes or pipe up to six inches in diameter that are positioned in apertures in the feet and extended down into holes in the bench B.

Figure 7A:
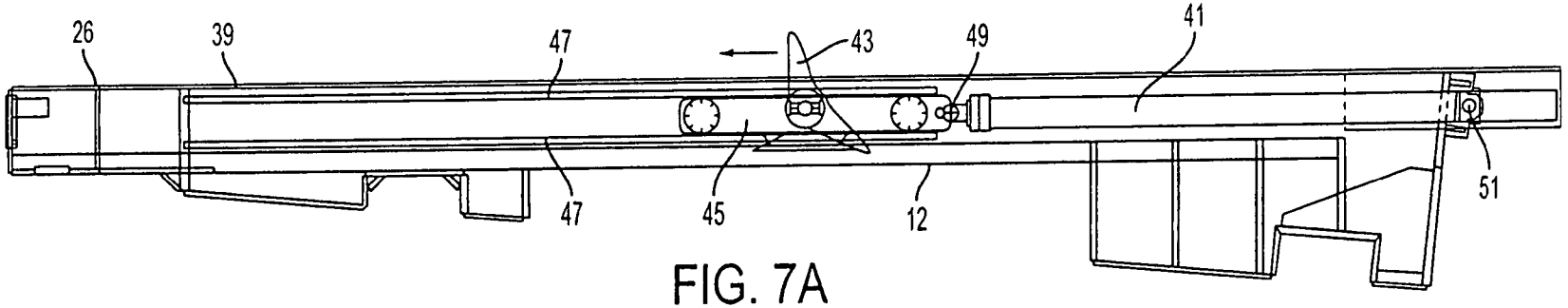
FIG. 7*a-c* shows partial side elevational views of the drive assembly in advancing, retracting, and transit positions, respectively.
Figure 7B:
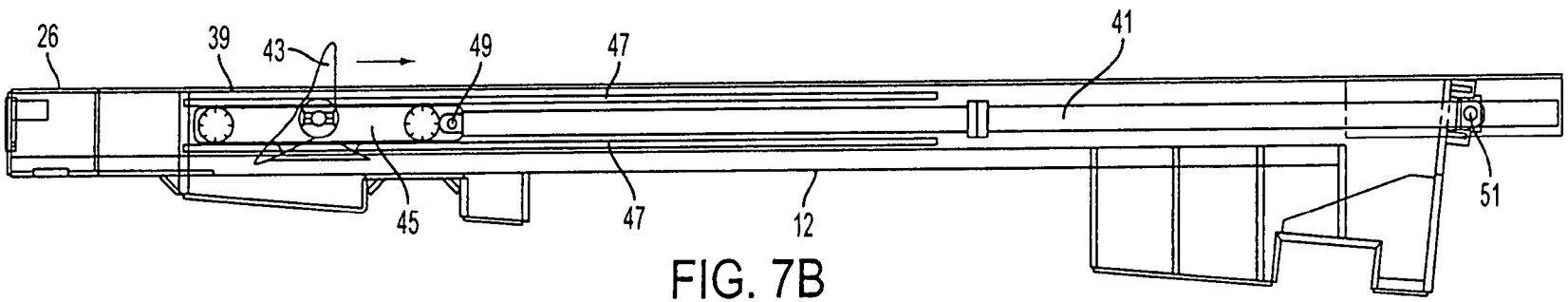
Figure 7C:
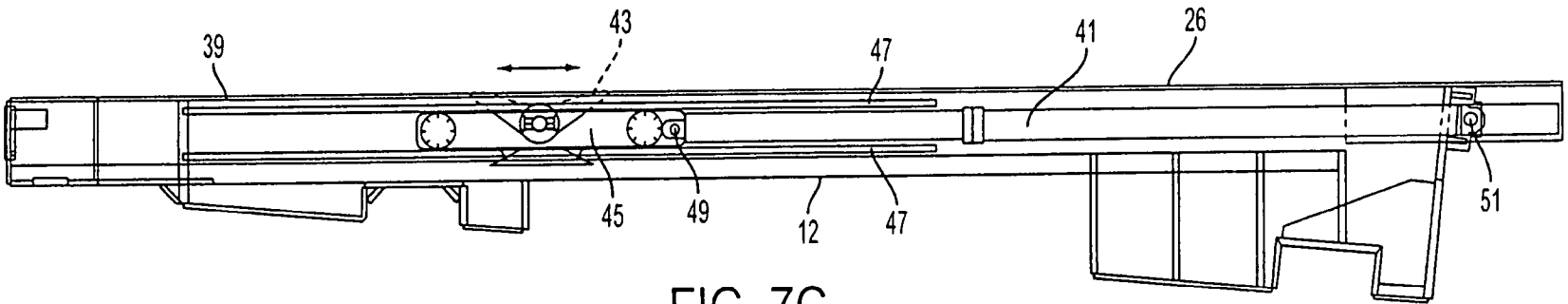
Figure 8:
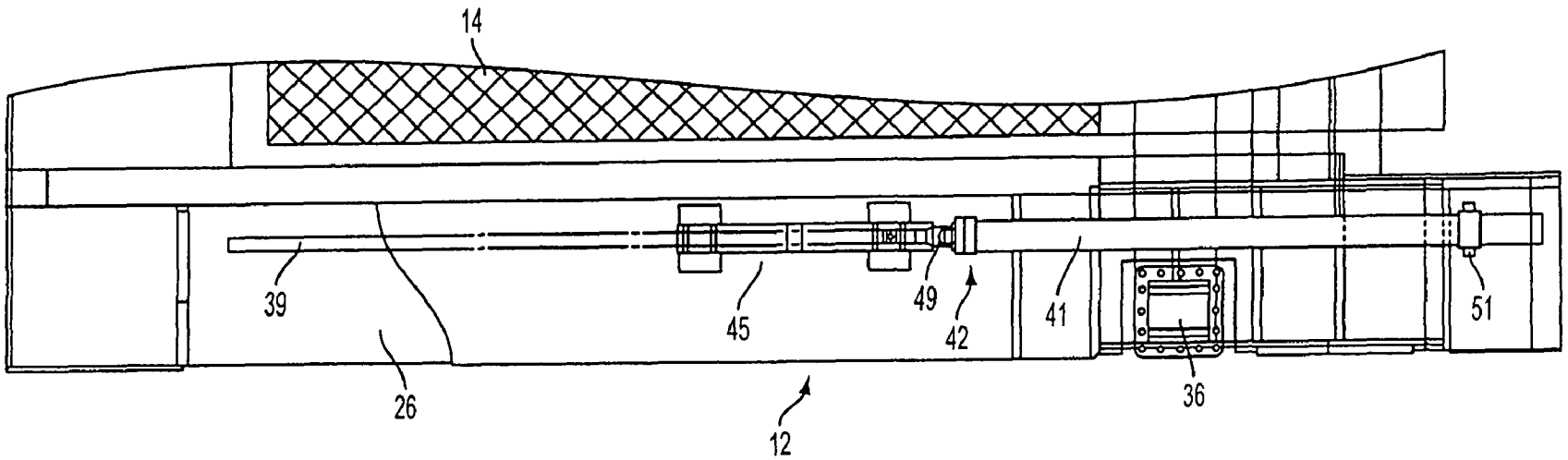
FIG. 8 is a partial top plan view of the drive assembly with the deck removed for clarity.

Referring now also to FIGS. 7 and 8, a drive assembly 42 is carried on the framework 12 and is utilized to advance or withdraw the conveyor train. In the illustrated embodiment the drive assembly 42 comprises cooperating tandem drive cylinders 41 mounted adjacent each side of the framework 12, preferably below the level of the deck 26. As is known in the art each drive cylinder 41 includes a pusher arm 43 that projects upwardly through a slot 39 in the deck 26 and is utilized to engage a cooperating pin P on a conveyor unit U in order to advance or withdraw the conveyor train into or from the coal seam.

As particularly shown in FIG. 7, the pusher arm 43 may pivoted into a pushing position (FIG. 7-*a*), a pulling position (FIG. 7-*b*) or may be in an intermediate transit position (FIG. 7-*c*) in which both fingers of the pusher arm 43 lie flush with the level of the deck 26 so that the pusher arm 43 may pass without engaging pin P on a conveyor unit U. The pusher arm 43 is pivotally carried by a wheeled truck 45 which travels along guide tracks 47. Each drive cylinder 41 is attached at one end to the truck 45 and at an opposite end to the framework 12 such as by pins 49 or trunnions 51.

Thus, it should be appreciated that the drive assembly 42 is sufficiently powerful to aid in advancing or withdrawing the conveyor train and mining machine into and from the seam face. This is a particularly important advantage as in many mining areas soft bottom conditions such as fire clay exist. Under these conditions the crawler assemblies on a conventional mining machine tend to dig ruts in the soft bottom until the main frame of the mining machine will "high center" and come to rest on the undisturbed material between the ruts. Accordingly, continuous mining machines have a propensity to become stuck where soft bottom conditions are present. Advantageously, the drive assembly 42 provides propulsion force in these conditions so that the mining machine and conveyor train may be advanced or withdrawn as necessary to mine the seam.

As best illustrated in FIGS. 2 and 3, the safety canopy 18 includes a hydraulic operated rock shield 44 at a front end thereof that may be pivoted so as to engage the face F of the mineral seam. The canopy 18 may also carry a reel 46 for paying out a continuous miner power line as the continuous miner and conveyor train are advanced into the seam. Similarly, the safety canopy 18 may also carry a reel 50 for paying out a conveyor car power line as the conveyor train moves into the seam. Additional reels 48, 52 are also provided for a water line and a control line. Of course, these reels 46, 48, 50, 52 also take up their respective lines (not shown) as the continuous miner and conveyor train are withdrawn from the seam.

In the illustrated embodiment, the main hydraulic unit 54 for hydraulic systems on the launch vehicle 10 and the electric unit 56 for the launch vehicle may also be carried on the canopy 18 where they are conveniently located. An operator cab 58 may be provided at approximately the level of the deck 26 and to the second side thereof where the operator may monitor the operation of the launch vehicle systems and the addition of individual conveyor units to the conveyor train.

As the continuous miner and conveyor train are advanced into the seam, the rear unit of the conveyor train approaches the front end of the launch vehicle 10. As this occurs, an operator uses a loader to lift an additional conveyor unit from a nearly location on the bench. That loader is then used to first move and then place that additional conveyor unit U onto the deck 26 of the launch vehicle immediately behind the rear unit of the conveyor train. Advantageously, the substantially L-shaped cantilever support 20 at the rear end (or both ends) of the launch vehicle 10 eliminates any need for a post at the first side so that the space is completely clear to allow the loader to position the next conveyor unit U onto the deck 26. Advantageously, the elimination of the support post at the first side and rear end of the launch vehicle 10 allows the launch vehicle to be made shorter yet still accommodate the addition of a conveyor unit. For example, a launch vehicle of only approximately 45 feet in length may be utilized to accommodate conveyor units 30 feet in length while a launch vehicle of approximately 60 feet in length may be utilized to accommodate conveyor units of approximately 45 feet in length. Advantageously, since the launch vehicle 10 may be made shorter, the mining system of the present invention may be utilized at mining sites with narrower benches.

After the new conveyor unit U is positioned on the deck 26, the new conveyor unit is connected to the rear of the conveyor train. The conveyor train is then advanced the length of a conveyor unit before the process is completed to add still another conveyor unit to the train. It should be appreciated that coal is being continuously conveyed during the addition of conveyor units. More specifically, initially the coal is conveyed from the last conveyor unit of the conveyor train to the belly conveyor 14 and then to the discharge conveyor 16. When the new conveyor unit is connected to the conveyor train, the coal is conveyed from the new conveyor unit either directly to the discharge conveyor or to the rearmost end of the belly conveyor and then to the discharge conveyor. Thus, continuous mining is possible.

In one possible embodiment of the invention, the main framework 12 of the launch vehicle 10 consists of two sets of stacked rectangle tubing on either side of the belly belt conveyor 14. These stringers are comprised of a 12"×20"×½" wall tube, welded on top of a 6"×12"×½" wall tube. The stringers are attached from side to side with horizontal cross tubes also made of rectangular tubing. The top cross tubes may be made from 8"×12"×½" wall tubing. The bottom cross tubes maybe made from 6"×10"×½" wall tubing. Five to eight sets of these cross tubes are used. The portion of the base outboard of the stringers consists of barrel gussets made of 3" alloy plate. These gussets are evenly spaced along the length of the launch vehicle 10. Tee sections made from heavy bar are strung between the barrel gussets to support the drive assembly 42. The gussets also support the 1" thick deck 26. This deck 26 supports the miner and first car, when the system is not mining, and the conveyor units U during the mining cycle. The barrel gussets also form the structure that mounts the four jacks 36 used to lift and skid the machine. This framework also provides for the attachment and support of the mounting flange and pilot fit for the rear "L" shaped cantilever support. Because the entire launch vehicle 10 is assembled in modular form for ease of transport, it will be appreciated that the "handedness" of the launch vehicle may be easily reversed by switching the attachment point of the cantilever support 20 to the opposite side of the main structural framework 12.

In summary, numerous benefits result from employing the concepts of the present invention. The launch vehicle 10 may be utilized in a system to provide continuous, uninterrupted cutting and conveying of coal from a seam face so as to maximize production. Advantageously, the cutting and conveying of the aggregate material continues even as additional modular conveyor units are added to the conveyor train. Advantageously, the use of one or more cantilever supports 20 allows the elimination of a canopy support post at one side of the launch vehicle. Thus, it is possible to provide the necessary clearance to allow the positioning of anew conveyor unit onto the deck of the launch vehicle without having to make the launch vehicle longer to provide the necessary clearance between posts at each end thereof.

The foregoing description of a preferred embodiment of the present invention has been presented for purposes of illustration and description. It is not intended to be exhaustive or to limit the invention to the precise form disclosed. Obvious modifications or variations are possible in light of the above teachings. For example, while the illustrated embodiment of the launch vehicle 10 incorporates only a single cantilever support 20, multiple cantilever supports could be provided. Further, all vertical support posts on one side of the canopy could be eliminated if desired.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A launch vehicle for a narrow bench continuous mining system including modular conveyor units that are connected together to form a conveyor train, comprising:

a main frame for supporting a rearmost conveyor unit of said conveyor train, said main frame including a first side over which additional conveyor units are added to said conveyor train and a second side;

a belly conveyor carried on said main frame that conveys aggregate material received from said rearmost conveyor unit of said conveyor train;

a drive assembly for selectively advancing and withdrawing said conveyor train; and a canopy overlying at least a portion of said main frame, said canopy being mounted on forward and rearward supports longitudinally spaced apart a distance less than substantially the length of a conveyor unit, at least one of said supports comprising a cantilever support extending upwardly adjacent said second side of said main frame and having a base attached to said main frame at a longitudinal position of said second side opposite a longitudinal position on said first side over which additional conveyor units are added to said conveyor train, whereby said first side is left open for adding additional conveyor units to said conveyor train.

2. The launch vehicle of claim 1, wherein said belly conveyor is a belt conveyor.

3. The launch vehicle, of claim 1, wherein said at least one cantilever support is of box beam construction.

4. The launch vehicle of claim 1, wherein said at least one cantilever support is provided adjacent a first end of said main frame.

5. The launch vehicle of claim 4, wherein said canopy is supported on two vertical support posts adjacent a second end of said main frame wherein a first post of said two vertical support posts is on said first side of said main frame and said second post of said two vertical support posts is on said second side of said main frame.

6. The launch vehicle of claim 5, further including a discharge conveyor carried on said main frame adjacent said first end, said discharge conveyor receiving aggregate material from said belly conveyor.

7. The launch vehicle of claim 6, further including a plurality of jacks supporting said main frame on a bench adjacent an exposed highwall.

8. The launch vehicle of claim 1, wherein said cantilever support is repositionable to allow said first and second sides of said mainframe to be interchanged.

9. A method of reducing the length of a launch vehicle for a continuous mining system including modular conveyor units that are connected together to form a conveyor train while maintaining sufficient clearance to allow a conveyor unit to be placed on said launch vehicle from a side thereof, comprising:

providing a launch vehicle main frame for supporting a rearmost conveyor unit of said conveyor train, said main frame including a first side over which additional conveyor units are added to said conveyor train and a second side; and supporting a canopy over at least a portion of the main frame of said launch vehicle by means of forward and rearward supports longitudinally spaced apart a distance less than substantially the length of a conveyor unit, at least one of said supports comprising a cantilever support having a base attached to said main frame at a longitudinal position of said second side opposite where additional conveyor units are added to said conveyor train.

10. The launch vehicle of claim 1, wherein said launch vehicle is less than about 90 feet in length.

11. The launch vehicle of claim 10, wherein said launch vehicle is about 45 feet in length.

12. The launch vehicle of claim 11, wherein said conveyor unit is about 30 feet in length.

13. The launch vehicle of claim 1, wherein said launch vehicle is assembled in modular form and may be assembled such that said first side and second side are reversed.

14. A reduced length launch vehicle for a narrow bench continuous mining system including modular conveyor units that are connected together to form a conveyor train, comprising:

a main frame for supporting a rearmost conveyor unit of said conveyor train, said main frame including a first end and a second end;

a belly conveyor carried on said main frame that conveys aggregate material received from said rearmost conveyor unit of said conveyor train;

a drive assembly for selectively advancing and withdrawing said conveyor train; and a canopy overlying at least a portion of said main frame, said canopy being supported on a cantilever support toward said first end and vertical support posts toward said second end;

wherein said cantilever support and said vertical support posts are longitudinally spaced apart a distance less than substantially the length of a conveyor unit.

15. The reduced length launch vehicle of claim 14, wherein said cantilever support is located adjacent said first end and said vertical support posts are located adjacent said second end.

16. The reduced length launch vehicle of claim 14, wherein said main frame includes a first side over which additional conveyor units are added to said conveyor train and a second side, and wherein said cantilever support extends upwardly adjacent said second side of said main frame and having a base attached to said main frame at a longitudinal position of said second side opposite a longitudinal position on said first side over which additional conveyor units are added to said conveyor train, whereby said first side is left open for adding additional conveyor units to said conveyor train.

17. The reduced length launch vehicle of claim 14, wherein said canopy carries a reel.

18. The reduced length launch vehicle of claim 17, wherein said vertical support posts are located at a longitudinal position beneath said reel.

19. The launch vehicle of claim 7, wherein said canopy includes a rock shield capable of engaging said exposed highwall.

* * * * *